US006358461B1

(12) United States Patent
Law et al.

(10) Patent No.: US 6,358,461 B1
(45) Date of Patent: Mar. 19, 2002

(54) METHOD OF MANUFACTURE OF NONWOVEN FABRIC

(75) Inventors: Stephen J. Law, Nuneaton; Heather Street; Gregory J. Askew, both of Coventry, all of (GB)

(73) Assignee: Tencel Limited, Derby (GB)

( * ) Notice: Subject to any disclaimer, the term of this patent is extended or adjusted under 35 U.S.C. 154(b) by 0 days.

(21) Appl. No.: 09/319,019

(22) PCT Filed: Dec. 9, 1997

(86) PCT No.: PCT/GB97/03391

§ 371 Date: May 28, 1999

§ 102(e) Date: May 28, 1999

(87) PCT Pub. No.: WO98/26122

PCT Pub. Date: Jun. 18, 1998

(30) Foreign Application Priority Data

Dec. 10, 1996 (GB) ..... 9625634

(51) Int. Cl.[7] ..... D01D 5/26; D01F 2/02; D04H 1/56

(52) U.S. Cl. ..... 264/518; 264/115; 264/121; 264/122; 425/72.2; 425/82.1; 425/83.1

(58) Field of Search ..... 264/115, 121, 264/122, 187, 518, 555; 425/72.2, 82.1, 83.1; 442/350, 409

(56) References Cited

U.S. PATENT DOCUMENTS

| | | | | |
|---|---|---|---|---|
| 2,988,782 A | | 6/1961 | Parrish | |
| 3,785,918 A | | 1/1974 | Kawai et al. | |
| 5,405,559 A | * | 4/1995 | Shambaugh | 264/115 X |
| 5,725,821 A | * | 3/1998 | Gannon et al. | 264/203 |

FOREIGN PATENT DOCUMENTS

| | | |
|---|---|---|
| FR | 2 735 794 | 12/1996 |
| WO | WO 94 28218 | 12/1994 |
| WO | WO 95/35400 | * 12/1995 |
| WO | WO 97 38153 | 10/1997 |
| WO | WO 98 07911 | 2/1998 |

* cited by examiner

*Primary Examiner*—Leo B. Tentoni
(74) *Attorney, Agent, or Firm*—Nixon & Vanderhye P.C.

(57) ABSTRACT

A method of manufacture of a nonwoven cellulose fabric is disclosed. The fabric is made from fibers formed by extrusion of a solution of cellulose through a spinning jet. The extruded fiber is attenuated with a high velocity gas flow, and the attenuated fiber is collected on a surface (such as the curved surface of a rotating drum) on which the fiber web is subsequently coagulated. Apparatus for carrying out the method is also disclosed. The method and apparatus permit the manufacture of a nonwoven lyocell fabric web in which fibers are bonded together without the use of a binder.

18 Claims, 2 Drawing Sheets

METHOD OF MANUFACTURE OF NONWOVEN FABRIC

BACKGROUND OF THE INVENTION

1. Field of the Invention

This invention relates to a method of manufacture of a nonwoven fabric made from cellulose and in particular from a solution of cellulose.

2. Discussion of Prior Art

Cellulose fibres and filaments may be produced by spinning a solution of cellulose in an amine oxide solvent which is then leached into water or a dilute solution of aqueous amine oxide, to produce cellulose filaments which can then be cut into staple fibres. The process of extrusion and coagulation is referred to as solvent spinning, and the fibres of solvent spun cellulose so produced are known under the generic name of lyocell.

It is possible to produce smaller decitex fibres below 1.0 dtex by disintegrating staple fibres. However, this is costly and requires a high energy consumption.

SUMMARY OF THE INVENTION

The present invention provides a cheap and effective process to produce a nonwoven textile comprising low decitex cellulose fibres.

Accordingly there is provided a method of manufacture of a nonwoven cellulose fabric made from fibres formed by extruding a solution of cellulose through at least one spinning jet and attenuating the extrudate fibre with high velocity gas flow, the attenuated fibre being collected on a surface on which the fibre web is subsequently coagulated.

The term 'gas' is intended to include vapours, such as steam.

The cellulose solution is preferably a solution of cellulose in an amine oxide solvent, typically a tertiary N-amine oxide and in particular N-methylmorphylene-N-oxide (NMMO). The cellulose solution may contain as little as 2% cellulose by weight; however, the solution preferably comprises 4–22% by weight of cellulose, having a degree of polymerisation of 200–5,000, and more typically 400–1,000.

In a preferred embodiment the cellulose solution comprises 15% by weight of cellulose, 10% by weight water and 75% by weight of NMMO, the cellulose having a degree of polymerisation of about 600.

The attenuated fibre-forming microfibres or fibrils are collected onto a surface and are then coagulated (alternatively referred to as being "regenerated") by means of water, or a dilute aqueous solution of amine oxide containing up to 20% amine oxide in water.

The gas, preferably air or steam, is blown onto the extruded fibres at a velocity of between 250 $m.s^{-1}$ (meters per second) and 500 $m.s^{-1}$ and has a temperature of between 125° C. and 155° C., preferably about 150° C. The lower the cellulose content of the dope, the lower the air temperature that can be used. The air temperature may be reduced to near 100° C. with low cellulose content dopes. The gas velocity should be at least 50 times higher than the velocity of the extrudate fibre emerging from the spinning jet, and preferably between 1,000 and 20,000 times said velocity. The air is directed onto the fibre extrudate at a bias angle, preferably of between 15 and 45° relative to the longitudinal axis of the extrudate, and more preferably about 30°. The air jets may also be biased at a second skew angle relative to the spinning jet so that the air jet axes and fibre axis do not intersect, the air jets being tangential to the surface of the fibre extrudate.

Also according to the invention there is provided an apparatus for the manufacture of a nonwoven fabric comprising lyocell fibres, the apparatus comprising a spinning nozzle through which a solution of cellulose is extruded in operation; one or more gas jets adapted to direct a stream of gas into the extrudate to attenuate the extrudate and form fibrils; a support surface adapted to collect the attenuated extrudate; and regeneration means for coagulating the fibrils on the support surface. Preferably the support surface is provided by the curved surface of a drum.

Because the fibrils or fibres are collected on the support surface before regeneration, the fibres in contact with each other can bond together.

Accordingly, the invention also provides a nonwoven lyocell fabric in which the fibres are bonded together without the use of a binder.

BRIEF DESCRIPTION OF THE DRAWINGS

The invention will hereinafter be described in more detail by way of example only, with reference to the accompanying drawings in which.

DETAILED DISCUSSION OF PREFERRED EMBODIMENTS

Figure 1:
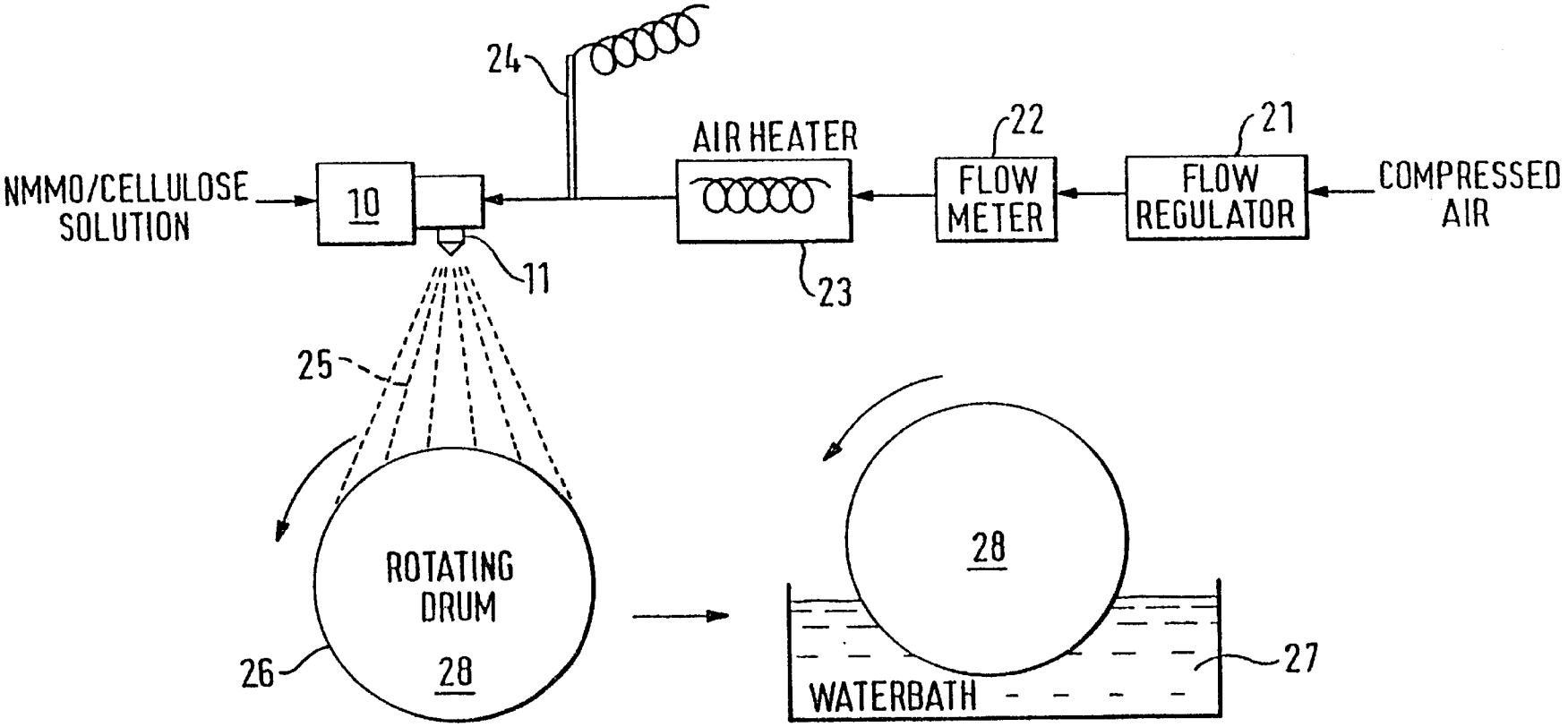
FIG. 1 is a schematic drawing of an embodiment of apparatus for the production of a nonwoven fabric according to the present invention.

With reference to FIG. 1, there is shown an extruder 10 having a nozzle 11 attached thereto. The extruder is fed with a solution comprising 15% by weight cellulose, 10% by weight of water and 75% by weight of N-methylmorphylene-N-oxide (NNMO). The cellulose has an average degree of polymerisation of about 600.

The cellulose solution may be manufactured as is described in WO 94/28217. The cellulose solution in the extruder is held at a temperature of between 95 and 110° C., preferably 105° C., and is forced through the nozzle to extrude as a continuous filament of cellulose dope.

Figure 2:
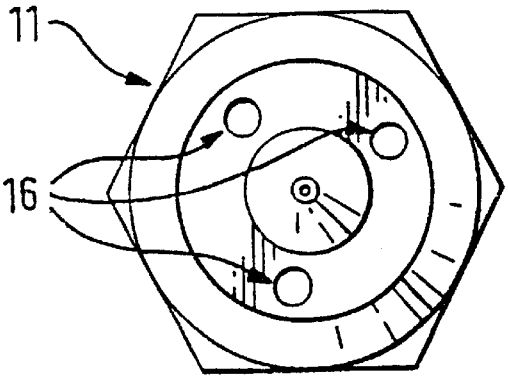
FIG. 2 is a plan view of a spinning jet nozzle used in the apparatus of FIG. 1.
Figure 3:
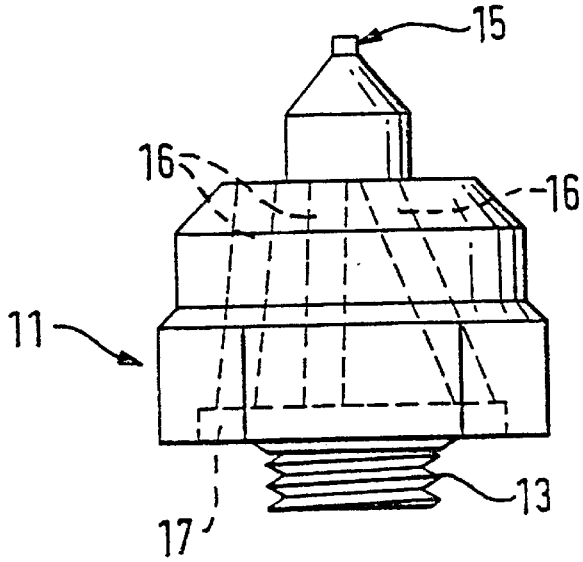
FIG. 3 is a side elevation of the nozzle shown in FIG. 2, with internal passages ghosted.
Figure 4:
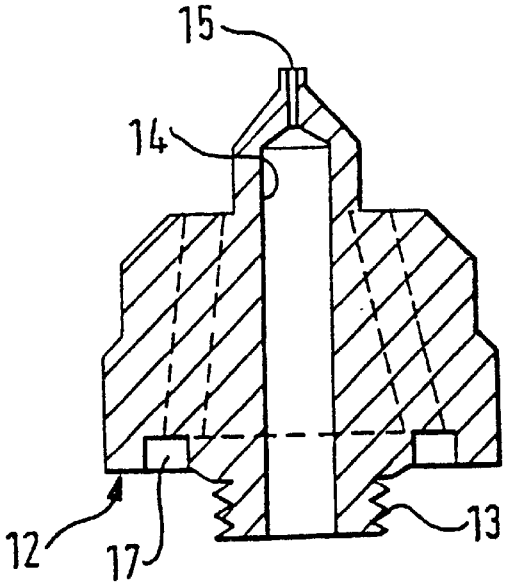
FIG. 4 is an axial cross-section through the nozzle shown in FIG. 2 and FIG. 3.

The nozzle 11 is shown in FIGS. 2 and 3 and may be secured directly onto the extruder 10, or may be secured to an adapter (not shown) which in turn is secured to the extruder 10. The nozzle 11 has a hollow screw threaded stud 13 on its back face 12 and a central passageway 14 which terminates in a jet aperture 15. The jet has a diameter of between 0.2 and 0.3 mm, and preferably about 0.27 mm.

The cellulose dope is forced into the passageway 14 under pressure, and is extruded through the jet is. The nozzle 11 also has a plurality of gas outlet passageways 16, preferably three, spaced around the central passageway 14. Each gas passageway 16 is inclined with respect to the jet axis, and they are circumferentially equally spaced around the jet 15 so that each gas stream exiting its respective passageway 16 has the same effect upon the extrudate filament.

The gas passageways 16 make a bias or convergence angle with the longitudinal axis of the jet of between 15° and 45°, and more preferably 30°. The passageways 16 are also skewed so that the axes of the passageways 16 do not themselves converge. The gas passageways 16 are about 2.0 mm in diameter. The back face 12 of the nozzle has an annular groove 17 therein which interconnects the ends of the three passageways 16.

When the nozzle is secured to the extruder, the central passageway 14 is connected to the cellulose dope feed and the annular passageway 17 is connected to a gas supply, preferably compressed air.

With reference to FIG. 1, compressed air is fed from a source (not shown) through a flow regulator valve 21, a flow meter 22, a heater 23 and a temperature sensor 24, to the air passageway 17 in the nozzle. The sensor 24 may be connected to the air heater 23 for control of the air temperature.

The extrudate filaments emerging from the nozzle 11 are subjected to attenuation by high velocity air streams 25 emerging from the outlet passageways 16, and the filament is drawn and fractured and blown onto a support surface 26 situated about 30 cm from the nozzle 11. In the illustrated embodiment the support surface 26 is formed by the outer peripheral surface of a rotatable drum 28, which turns at about 10 revolutions per minute (rpm) to build up a layer of nonwoven fabric on the drum.

Subsequent to the formation of the nonwoven fabric layer on the drum 28, the drum 28 is immersed in a coagulant bath 27 containing a suitable coagulant such as water, or a dilute solution of amine oxide in water, to coagulate the nonwoven cellulose fabric on the drum. The fabric layer is dried on the drum.

Table 1 below summarises the various conditions used in the formation of extruded filament in relation to their average filament diameter.

TABLE 1

| Experiment Number | Cellulose Dope flow-rate (g/min) | Air Temperatures (° C.) | Air flow rate (L/sec) | Mean dry fibre diameter (μm) |
|---|---|---|---|---|
| 1 | 0.2 | 106 | 2.4 | 18 |
| 2 | 0.2 | 106 | 2.7 | 16 |
| 3 | 0.2 | 106 | 3.0 | 16 |
| 4 | 0.2 | 128 | 2.4 | 12 |
| 5 | 0.2 | 128 | 2.7 | 12 |
| 6 | 0.2 | 128 | 3.0 | 10 |
| 7 | 0.2 | 146 | 2.4 | 10 |
| 8 | 0.2 | 146 | 2.7 | 9 |
| 9 | 0.2 | 146 | 3.0 | 7 |
| 10 | 0.2 | 152 | 3.0 | 5 |

The air flow rates 2.4, 2.7 and 3.0 $l.s^{-1}$ (liters/second) correspond approximately to air velocity of 250, 290 and 320 $m.s^{-1}$.

As can be seen in Table 1 for any given air flow rate, as the temperature of the air is increased finer filaments are produced.

The effect of % cellulose dissolved in solution on filament diameter was demonstrated by passing different concentration solutions through the jet, as shown in Table 2. The amine oxide/water ratio was kept substantially constant with that described earlier. The air flow rate was 2.4 liter per second, and the degree of polymerisation of the cellulose was 570.

TABLE 2

| % Cellulose in solution | Dope flow rate (g/min) | Air temp ° C. | Average filament diameter μm |
|---|---|---|---|
| 15 | 0.2 | 128 | 12 |
| 8 | 0.33 | 130 | 4 |
| 5 | 0.13 | 130 | 2 |

As can be seen by comparison with Table 1, the lower cellulose content spinning solutions allows finer filaments to be produced.

The fibres of known average diameter were collected on the rotating drum 28 under two different conditions:

(i) where the surface of the drum is partially immersed in the coagulation bath so that the drum is wet and coagulation take place on contact with the wet drum or previously laid fibres (referred to below as wet), and (ii) where the surface of the drum is dry and the fabric regenerated after build up on the drum (referred to below as dry).

Table 3 summarises the properties of the fabric webs formed on the drum 26.

TABLE 3

| Basis Weight ($g \cdot m^{-2}$) | Method of laydown | Average filament Diameter (μm) | Tensile strength (Kg/cm) | Tensile strength (Kg/cm) (Normalised to basis of 25 $g \cdot m^{-2}$) |
|---|---|---|---|---|
| 94 | Wet | 12 | 1.15 | 0.31 |
| 12 | Wet | 9 | 0.05 | 0.1 |
| 24 | Dry | 6 | 1.10 | 1.15 |
| 16 | Dry | 9 | 0.42 | 0.66 |
| 5 | Dry | 5 | 0.18 | 0.9 |

To assess mechanical properties, strips were cut from the webs, 5 mm in width, and tested on an Instron tensile testing machine, at a gauge length of 20 mm and cross-head speed of 200 mm/min. Along with the absolute tensile strengths, the tensile strengths are also shown normalised to a basis weight of the web of 25 $gm^{-2}$, which better reflects the comparative mechanical properties, as basis weight variations are eliminated.

Webs made by collecting fibres directly onto a moving surface, and regenerating after collection, exhibit superior mechanical properties to fibres collected into regenerant, or onto a surface covered with regenerant.

The ratio of the mechanical properties in the machine direction (MD) to those in the cross-direction (CD) is also affected by the speed of the moving surface. By increasing the collection belt or roller speed the MD strength is increased at the expense of the CD strength. This is shown below in Table 4 in which a 14% cellulose solution was processed into microfibres.

TABLE 4

| Air temp ° C. | Air flow rate m/sec | Linear speed m/min | MD:CD Tensile Strength |
|---|---|---|---|
| 140 | 2.4 | 9 | 1.5 |
| 140 | 2.4 | 38 | 2.2 |

The webs of fibres collected on the drum surface 26 may be calendered prior to regeneration to alter the physical properties of the web, and the fibres collected on the wet drum may also be passed through coagulant after collection on the drum.

A further aspect of the invention is the incorporation of a second component into the web by incorporating the second component into the attenuating gas stream. The second component becomes intimately bonded into the cellulose matrix collected on the drum. For example, the pore size of the web may be altered by calendering. Typically, the pores are made smaller.

This procedure can be used to increase water absorbency by the incorporation of fluff pulp, or to reduce water absorbency by the incorporation of a hydrophobic material such as polypropylene.

The material can be added to the air stream as fibres or as powder. Typical material may include nylon fibres, carbon fibres, cellulose acetate fibres or powder, cellulose acetate butyrate.

When a thermoplastic material is incorporated into the web the possibility exists to hot calendar the web after regeneration to melt the thermoplastic and form a continuous structure with lyocell fibres embedded therein.

If the laid down web is calendered before regeneration, a continuous cellulose matrix may be formed filled with dispersed additive.

We claim:

1. A method of manufacture of a nonwoven cellulose fabric made from fibres comprising the steps of:

extruding a solution of cellulose through at least one spinning nozzle;

attenuating the extrudate fibre with high velocity gas flow to form an attenuated fibre;

collecting the attenuated fibre on a support surface to form a fibre web; and coagulating said web by leaching solvent therefrom.

2. A method as claimed in claim 1, wherein the cellulose solution is a solution in an amine oxide solvent, and the fibre web is coagulated in an aqueous medium.

3. A method as claimed in claim 1, wherein the gas flow has a gas flow rate of at least 250 meters per second.

4. A method as claimed in claim 3, wherein the gas flow is at least 50 times faster than the flow rate at which the extrudate fibre is extruded.

5. A method as claimed in claim 1, wherein the gas of the gas flow has a temperature of at least 100° C.

6. A method as claimed in claim 1, wherein the support surface is located at a distance of about 30 cm from said at least one spinning nozzle.

7. A method as claimed in claim 1, wherein the cellulose solution contains from 4–22% by weight cellulose.

8. A method as claimed in claim 1, wherein the cellulose has an average degree of polymerisation of about 600.

9. A method as claimed in claim 1, wherein said gas flow comprises compressed air which is directed onto the fibres at a bias angle of about 30° to the axis of the extrudate fibre.

10. A method as claimed in claim 1, wherein the attenuated fibre is collected onto a dry surface.

11. A method as claimed in claim 1, wherein the attenuated fibre is collected on a surface which is wetted by a coagulant.

12. A method as claimed in claim 1, wherein the fibre web collected on the surface is compressed prior to treatment with coagulant.

13. A method as claimed in claim 1, wherein a second material is incorporated into the fibre web, by incorporation of said second material into the gas flow.

14. Apparatus for the manufacture of a nonwoven fabric comprising lyocell fibres, the apparatus comprising:

a spinning nozzle through which a solution of cellulose in solvent is extruded in operation to form an extrudate;

at least one gas jet adapted to direct a gas stream onto the extrudate to attenuate the extrudate and form fibrils;

a support surface adapted to collect the attenuated extrudate; and a regeneration means for coagulating the fibrils on the support surface by leaching of said solvent from said fibrils.

15. Apparatus as claimed in claim 14, wherein the support surface is provided by the curved surface of a rotating drum.

16. Apparatus as claimed in claim 15, in which at least a portion of the drum is immersed in a regeneration bath.

17. A method as claimed in claim 5, wherein the gas of the gas flow has a temperature of about 150° C.

18. A method as claimed in claim 7, wherein the cellulose solution contains from about 5 to 15% by weight of cellulose.

* * * * *